US006046704A

United States Patent [19]

Lopez

[11] Patent Number: 6,046,704

[45] Date of Patent: Apr. 4, 2000

[54] STAMP-AND-BEND DOUBLE-TUNED RADIATING ELEMENTS AND ANTENNAS

[75] Inventor: Alfred R. Lopez, Commack, N.Y.

[73] Assignee: Marconi Aerospace Systems Inc. Advanced Systems Division, Greenlawn, N.Y.

[21] Appl. No.: 09/225,587

[22] Filed: Jan. 6, 1999

[51] Int. Cl.[7] ..... H01Q 9/28

[52] U.S. Cl. ..... 343/821; 343/795; 343/822

[58] Field of Search ..... 343/700 MS, 795, 343/810, 812, 813, 814, 815, 816, 817, 818, 820, 821, 822

[56] References Cited

U.S. PATENT DOCUMENTS 4,445,122 4/1984 Pues ..... 343/700 MS
4,513,292 4/1985 Bowman ..... 343/795
4,816,839 3/1989 Landt ..... 343/795

*Primary Examiner*—Don Wong
*Assistant Examiner*—James Clinger
*Attorney, Agent, or Firm*—Edward A. Onders; Kenneth P. Robinson

[57] ABSTRACT

Double-tuned radiating elements 10 for cellular antennas are configured to enable stamping in one piece from flat sheet metal. Unitary construction incorporates a radiating section 22, an exciter section 14 and a balun section 12 in each radiating element. After the element is formed in one flat piece, a 90 degree bend is made along bend line BL to position radiating section 22 normal to the exciter and balun sections. When mounted in an antenna with the exciter and balun sections 14 and 12 parallel to a conductive ground plane surface, radiating section 22 extends forward normal to the ground plane surface. Radiating section 22 and exciter section 14 are fed by direct coupling to balun section 12, via shared current paths.

19 Claims, 5 Drawing Sheets

H-PLANE FIG. 7
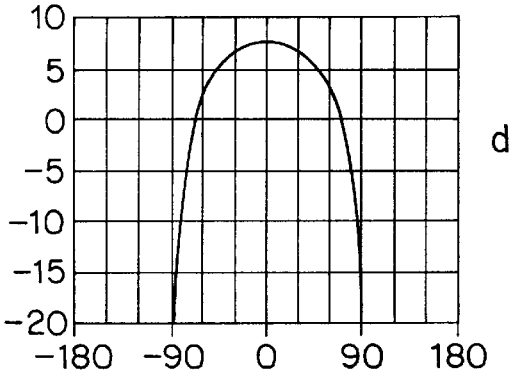
E-PLANE FIG. 10
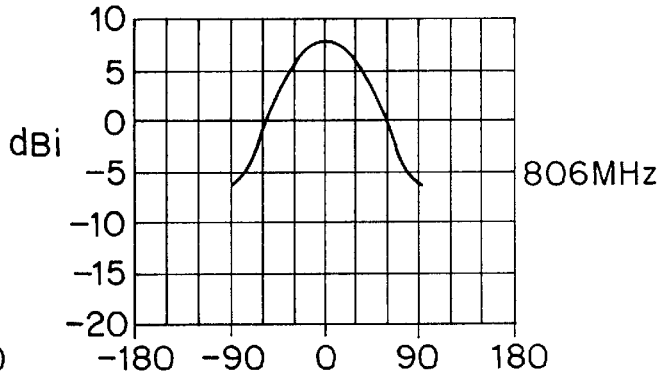
FIG. 8
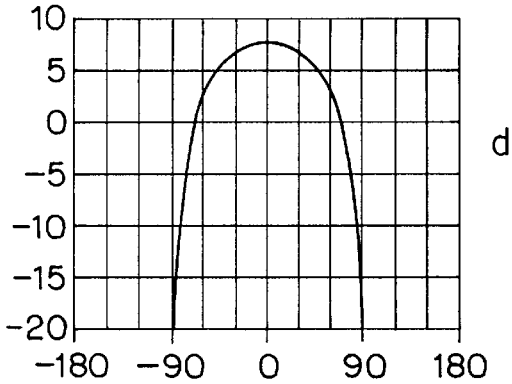
FIG. 11
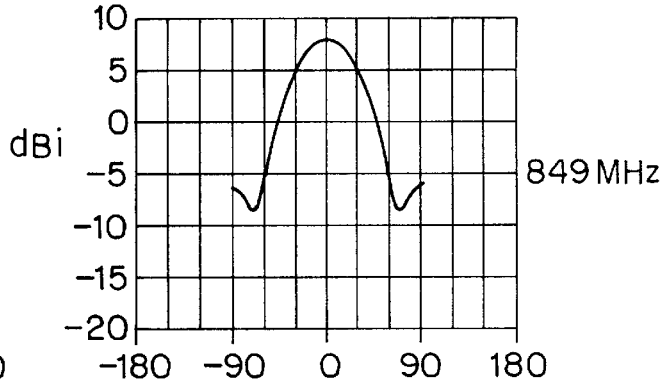
FIG. 9
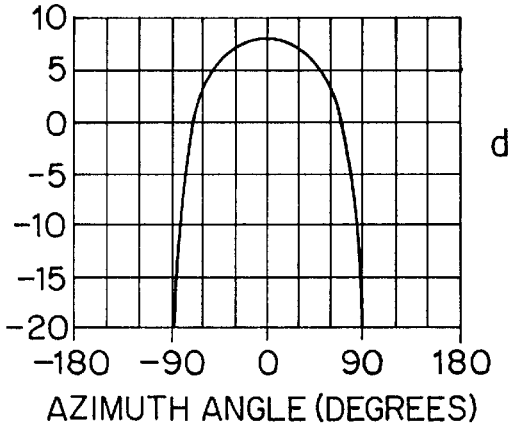
FIG. 12
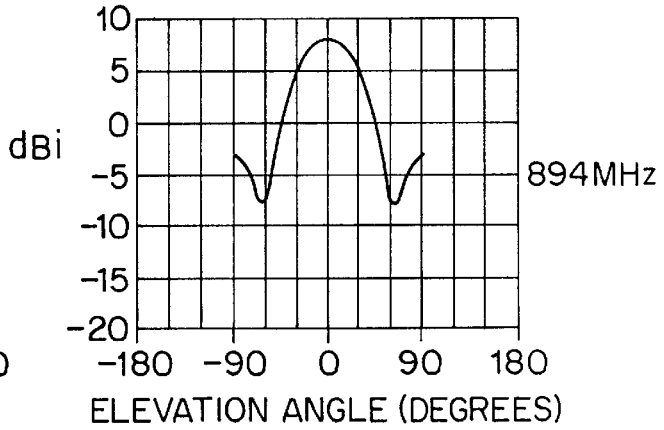

STAMP-AND-BEND DOUBLE-TUNED RADIATING ELEMENTS AND ANTENNAS

RELATED APPLICATIONS (Not Applicable)

FEDERALLY SPONSORED RESEARCH (Not Applicable)

BACKGROUND OF THE INVENTION

This invention relates to radiating elements and antennas and, more particularly, to double-tuned elements economically fabricated from sheet stock and usable in linear array antennas for cellular applications.

For a variety of reasons it is desirable to provide highly reliable, low cost antennas suitable for meeting the requirements of cellular communication applications. As a result of operational characteristics and signal levels of cellular systems, spurious intermodulation effects which may be produced in antennas at electrical contact points are particularly undesirable. Contact points or physical connections existing where radiating elements are interconnected or are connected to feed lines may give rise to such intermodulation products. Intermodulation product (IMP) problems may thus result from bimetallic contacts, corrosion effects over time, and combinations of materials resulting in contact points with semiconductor-like characteristics.

While simplicity of construction and low cost construction are common objectives in antenna design, in cellular applications such objectives may be directly consistent with considerations important to achieving the lowest levels of intermodulation effects. Thus, complex antenna designs relying on assembly of many components may provide a variety of possible sources of intermodulation effects. Conversely, if a simple one-piece radiating element construction could be provided with a reduced number of component contact points, sources of intermodulation effects would be avoided. At the same time, benefits of low cost and ease of assembly could also be achieved. Many of these objectives are achieved in U.S. Pat. No. 5,742,258, titled "Low Intermodulation Electromagnetic Feed Cellular Antennas" and commonly assigned with the present application.

Objects of the present invention are to provide new and improved radiating elements and antennas utilizing such elements having one or more of the following advantages and characteristics:

- simplified one piece construction;
- integrated configuration including radiating, exciter and balun sections;
- double-tuned radiating element with simplified onepiece configuration;
- two step fabrication, stamp from sheet stock and provide a single 90 degree bend;
- broad-band, double-tuned operation;
- radiating section, exciter section and balun section stamped in one piece from conductive sheet stock; and
- self-supported rectangular radiating section bent to position normal to antenna ground plane surface.

SUMMARY OF THE INVENTION

In accordance with the invention, a stamp-and-bend radiating element is stamped in one piece from sheet metal and bent so a second portion is positioned nominally normal to a first portion, with the second portion supported only by connection to the first portion. The first portion includes (i) a balun section having an input/output port and a signal feed port, and (ii) an exciter section coupled to the signal feed port. The second portion includes a radiating section having a near edge connected to the exciter section and coupled to the signal feed port and having a distal edge.

The design is such that the radiating element may be stamped in one piece from a flat sheet of sheet metal and then subjected to a single 90 degree bend. Broad band double-tuned operation is achieved by proportioning the exciter section and the radiating section so as to be tuned to a predetermined frequency, with the exciter section directly connected to the radiating section.

Also in accordance with the invention, an antenna, including a double-tuned radiating element, includes a conductive ground plane surface and a radiating element. The radiating element has a first portion positioned nominally parallel to the ground plane surface and a second portion positioned nominally normal to the ground plane surface. The second portion is supported by connection to the first portion. The first portion includes (i) a balun section having an input/output port and a signal feed port, and (ii) an exciter section coupled to the signal feed port and tuned to a predetermined frequency. The second portion includes a radiating section having a near edge connected to the exciter section and coupled to the signal feed port and having a distal edge, with the radiating section tuned to the predetermined frequency.

An antenna pursuant to the invention may typically include a plurality of such radiating elements positioned in a linear array and a signal distribution conductor connected to the input/output port of each element.

For a better understanding of the invention, together with other and further objects, reference is made to the accompanying drawings and the scope of the invention will be pointed out in the accompanying claims.

BRIEF DESCRIPTION OF THE DRAWINGS

FIGS. 7, 8 and 9 are computed azimuth plane radiation patterns for the antenna of FIGS. 3 and 4 at frequencies in an operating band.

FIGS. 10, 11 and 12 are computed elevation plane radiation patterns for the antenna of FIGS. 3 and 4 at frequencies in an operating band.

DESCRIPTION OF THE INVENTION

Figure 1:
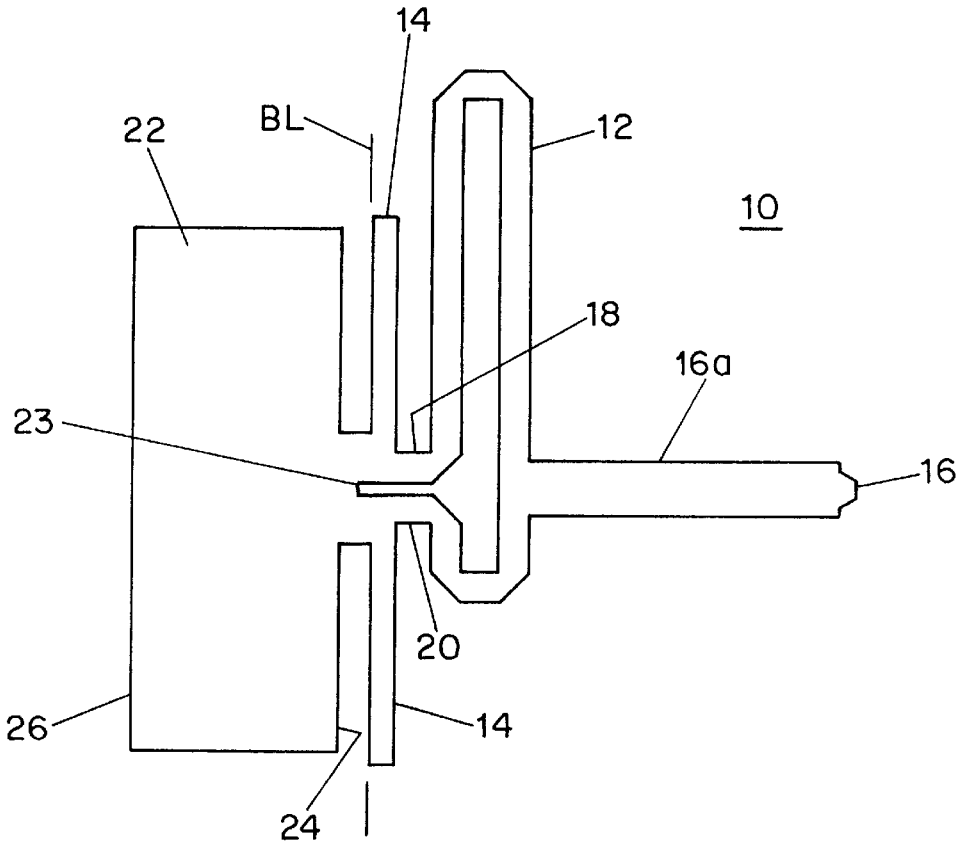
FIG. 1 is a plan view of a radiating element in accordance with the invention, in flat form as stamped in one piece from conductive sheet stock.
Figure 2:
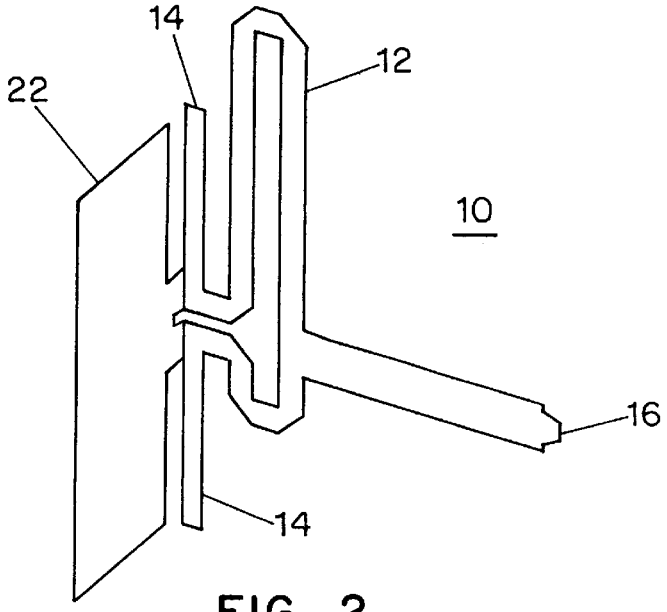
FIG. 2 is a perspective view of the FIG. 1 radiating element after being subjected to a 90 degree bend along line BL.

A stamp-and-bend radiating element 10 in accordance with the invention is illustrated in FIGS. 1 and 2. A portion of an antenna incorporating radiating element 10 is illustrated in side and front views in FIGS. 3 and 4.

FIG. 1 shows radiating element 10 in flat form after it has been stamped or otherwise formed from thin conductive material, such as brass sheet stock. Element 10 consists of two portions separated by the bend line "BL" identified in FIG. 1.

The first portion, shown to the right of the BL, comprises a balun section 12 and an exciter section 14. In the illustrated embodiment, balun 12 has an input/output port 16 and two signal feed ports 18 and 20. As shown, balun 12 comprises upper and lower conductor patterns which, in the context of the invention, can be proportioned by application of known design techniques to provide a balanced feed. Input/output port 16 is provided to enable connection of the radiating element to a signal distribution conductor of an antenna, as will be described further with reference to FIG. 5. A conductor section 16*a*, of length suitable for a particular antenna construction, couples signals between port 16 and the element 10. Signal feed ports 18 and 20, as shown in FIG. 1, have the form of conductive connections between balun 12 and the upper and lower segments of tuned section 14.

As noted, the first portion of radiating element 10 also includes exciter section 14. In this embodiment, exciter section 14 includes two elongated segments extending oppositely, parallel to the BL, with each segment connected to and extending from a different one of the two signal feed ports 18 and 20 as shown. By application of known design techniques in the context of the invention, exciter section 14 is proportioned so as to be tuned (e.g., for primary resonance) to a selected frequency within the intended operating frequency band of an antenna. While exciter section 14 is illustrated as comprising two oppositely-extending elongated segments, other tuned exciter configurations may be employed as suitable for different embodiments and applications.

The second portion of radiating element 10, which appears to the left of the BL in FIG. 1, comprises radiating section 22. As illustrated, radiating section 22 is of flat rectangular form, with the long sides of the rectangular form identified as near edge 24 and distal edge 26. As shown, near edge 24 is connected to the exciter section 14, such connection providing the only mechanical support for radiating section 22 in this embodiment. The near edge 24 of radiating section 22 is coupled, via exciter section 14, to the two signal feed ports 18 and 20. Similarly as for exciter section 14, radiating section 22 is tuned to the selected frequency within the operating band. It will be understood by skilled persons that appropriate "double" tuning of a radiating element (e.g., by tuning portions 14 and 22 as described) can be employed to broaden the useful operating frequency bandwidth. With the illustrated construction, double tuned operation is provided in the context of radiating section 22 being directly connected to exciter section 14, so that these sections share current paths and are thus directly coupled, rather than relying upon magnetic or capacitive coupling as in other antenna designs.

As shown in FIG. 1, the connections from feed ports 18 and 20 to radiating section 22 via exciter section 14 are electrically coupled at bridging connection 23. In order to achieve desired double-tuned operation, the level of coupling between exciter section 14 and radiating section 22 can be adjusted by altering the physical design to change the position of bridging connection 23. As bridging connection 23 is positioned further to the left in FIG. 1 coupling increases, and vice versa. By appropriate placement, the desired level of coupling for effective double-tuned operation is achieved.

In FIG. 2, the radiating element of FIG. 1 has been subjected to a single bend along the bend line BL of FIG. 1. As represented in FIG. 2, the element 10 has been bent so that the second portion (i.e., radiating section 22) is positioned nominally normal to the first portion (i.e., including exciter section 14 and balun 12). As will be described further, when installed for use in an antenna, exciter section 14 and balun 12 may be appropriately mechanically supported in spaced parallel relation to a ground plane. Radiating section 22 will then be supported in a normal or perpendicular position only by its connection to exciter section 14. For purposes of this application, "nominally" is defined as within plus or minus 20 percent of a stated condition or relationship (e.g., plus or minus 18 degrees of perpendicular) in order not to unnecessarily limit claim coverage of elements and antennas employing the invention.

Figure 3:
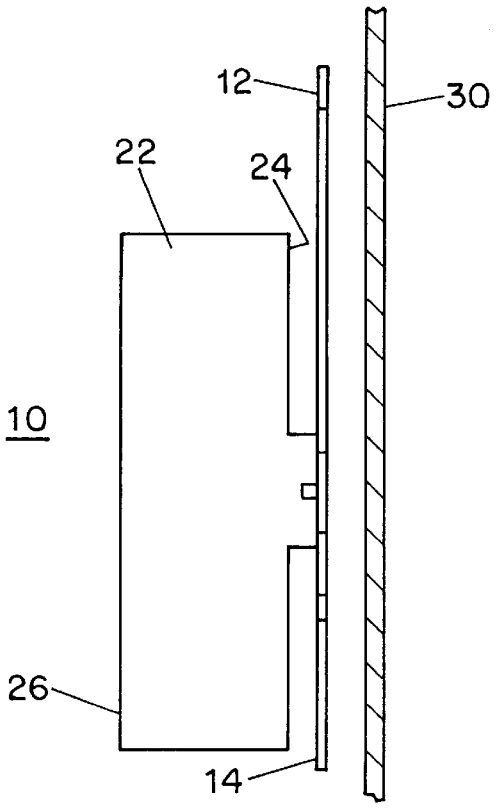
FIG. 3 is a side view of an antenna including the FIG. 2 radiating element positioned in front of a section of a conductive ground plane.
Figure 4:
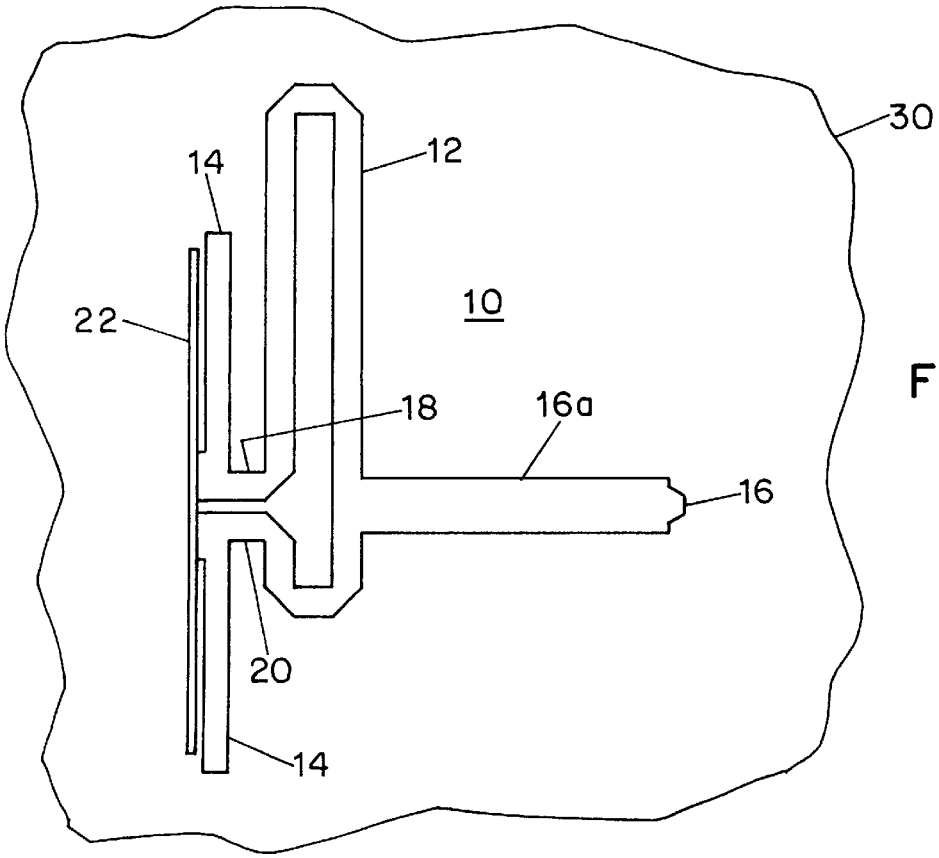
FIG. 4 is a front view of the FIG. 3 antenna.

FIGS. 3 and 4 are side and front views of a portion of an antenna in accordance with the invention, which includes radiating element 10 of FIGS. 1 and 2 positioned in front of a section 30 of a conductive ground plane of the antenna. In known manner, the front surface of ground plane section 30 provides a conductive ground plane surface behind element 10. When radiating element 10 is employed in an antenna as illustrated, it will be seen that the first portion (i.e., balun 12 and exciter section 14) is positioned nominally parallel to the surface of the ground plane 30, with the second portion (i.e., radiating section 22) positioned nominally normal both to ground plane surface and to the first portion. The antenna construction is shown in simplified form in FIGS. 3 and 4, without support elements to hold balun 12 and tuned section 14 in position relative to ground plane 30. Also, the structure of the ground plane unit, signal distribution conductor configuration to connect to output port 16, etc., are not illustrated. Reference is made to the description in U.S. Pat. No. 5,742,258, entitled "Low Intermodulation Electromagnetic Feed Cellular Antennas" and having a common assignee. This patent, which is hereby incorporated by reference, provides description of a reflector assembly, a signal distribution conductor and network supported in spaced relation to the reflector, and associated connector, radome and other elements which may be utilized in a complete antenna pursuant to the invention. Alternatively, other appropriate arrangements and configurations may be employed in application of the invention.

Figure 5:
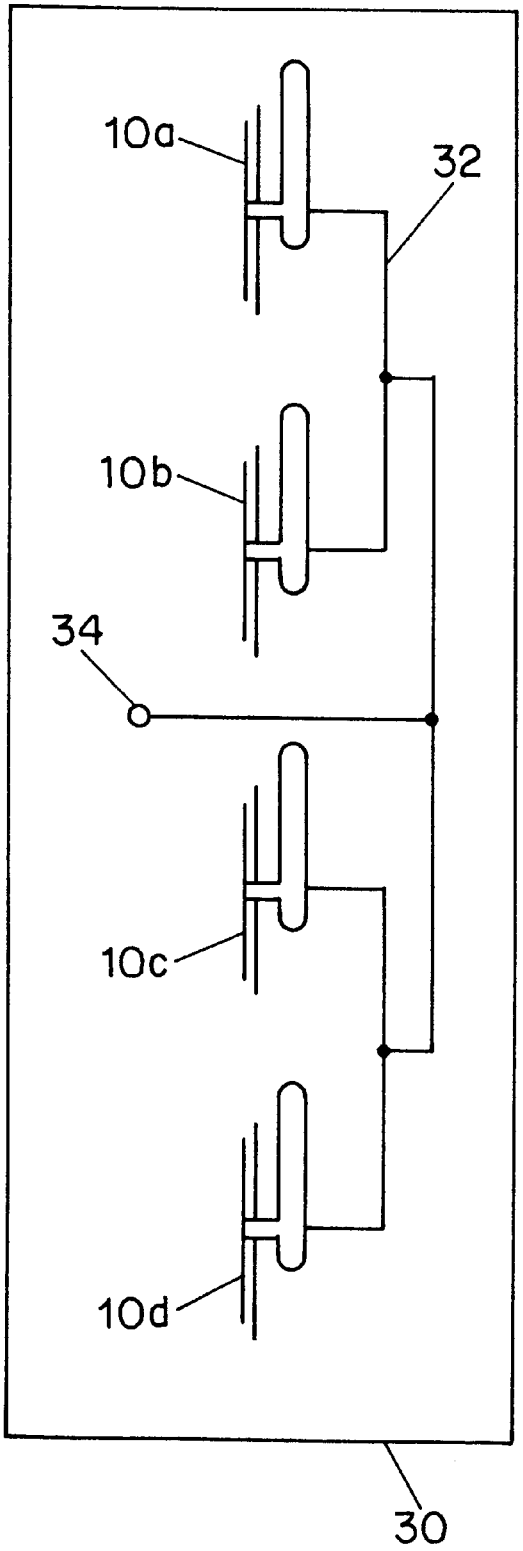
FIG. 5 is a simplified front view of an antenna including a plurality of FIG. 2 type radiating elements arrayed vertically.

Consistent with the foregoing, FIG. 5 is a simplified front view similar to the FIG. 4 view, but including elements 10*a*, 10*b*, 10*c* and 10*d*, each of which has the form of radiating element 10 of FIGS. 3 and 4, positioned in a vertical array in front of ground plane 30. In FIG. 5, the elements are connected to a parallel feed type of signal distribution conductor 32. As shown, signal distribution conductor 32 actually comprises a signal distribution network which connects to the input/output port of each of elements 10*a*–10*d* and also connects to an antenna port 34, which may be a coaxial connector passing through reflector 30. Signal distribution conductor 32 in this embodiment may be spaced from the face of reflector 30 in parallel relationship thereto and supported by suitable insulative spacers fixed to the reflector. Depending upon structural requirements, the radiating elements 10*a*–10*d* may be physically supported solely by the signal distribution conductor 32, by insulative supports fixed to the reflector, or in other suitable fashion. The drawings are not necessarily to scale and dimensions may be distorted for clarity of presentation.

In implementation of the configuration as described, radiating elements 10*a*–10*d*, together with all or a significant portion of signal distribution conductor 32 as represented in FIG. 5, may be cut or stamped as a single unitary pattern from a sheet of brass stock or other conductive material. The respective radiating elements 10*a*–10*d* may then be bent at the bend line "BL" of FIG. 1 so that the radiating sections 22 are each normal to conductor 32 and the ground plane surface, as shown in FIGS. 3 and 4. With this arrangement, conductor 16*a* is merely a portion of distribution network 32 and the signal distribution/radiating element structure includes a minimum of joints or electrical connections. With the radiating elements and distribution network supported in front of the reflector 32, atmospheric protection may be provided by a suitable radome. In particular, input/output port 16 of each radiating element may thus exist merely as a point on conductor 32 near balun section 12, rather than as a discrete port or contact point.

To provide signal access, input/output port 34 may be a coaxial connector fixture passing through reflector 12 to enable coaxial cable connection from the back of reflector 12 for antenna feed purposes. The reflector, signal distribution conductor and associated connector, radome and other antenna components may be provided as discussed with reference to the patent identified above.

Figure 6:
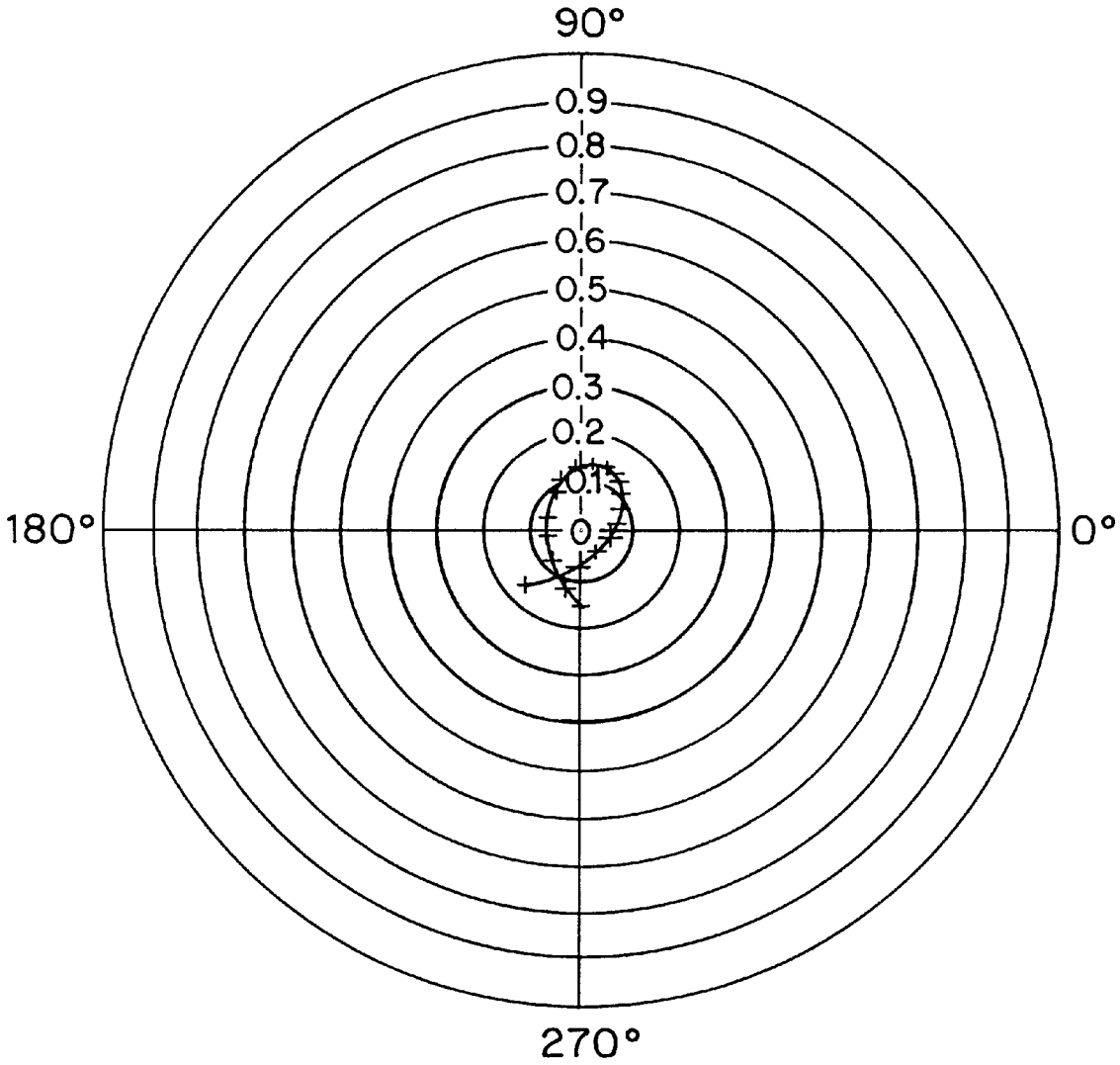
FIG. 6 is a computed reflection locus for the antenna of FIGS. 3 and 4.

Referring now to FIG. 6, there is shown a computed reflection locus, normalized to 47 Ohms, for an antenna design in accordance with FIGS. 3 and 4. In this design, and with reference to the FIG. 1 "flat" view, each edge 24 and 26 of radiating section 22 was about 5.8 inches long and the width of section 22 was about 2.3 inches. End-to-end, the upper and lower segments of exciter section 14, configured as shown, together had a total length of about 6.0 inches. The lower portion of balun section 12 had a vertical length of about 1.2 inches and a width of about 1.1 inches and the upper portion had a vertical length of about 4.7 inches, with individual conductor portions about 0.3 inches wide. Balun section 12 was fed by a signal distribution conductor 16*a* configured as a 50 Ohm microstrip line with 0.125 inch spacing from the ground plane. This radiating element configuration was designed for operation within an 800 to 900 MHz frequency band.

Computed azimuth plane radiation patterns are provided in FIGS. 7, 8 and 9 for frequencies of 806, 849 and 894 MHz, respectively. Corresponding elevation plane radiation patterns are provided in FIGS. 10, 11 and 12. FIGS. 7–12 are computed patterns for an initial design of the FIG. 1 radiating element which had dimensions differing slightly from those provided above. The gain as computed at the respective frequencies is as follows: 8.0 DBi at 806 MHz; 8.7 DBi at 649 MHz and 8.6 DBi at 894 MHz.

While there have been described the currently preferred embodiments of the invention, those skilled in the art will recognize that other and further modifications may be made without departing from the invention and it is intended to claim all modifications and variations as fall within the scope of the invention.

I claim:

1. A stamp-and-bend radiating element comprising:

a radiating element stamped in one piece from sheet stock and bent so a second portion of said element is positioned nominally normal to a first portion of said element and supported only by connection to said first portion;

said first portion comprising (i) a balun section having an input/output port and a signal feed port, and (ii) an exciter section coupled to said signal feed port; and said second portion comprising a radiating section having a near edge connected to said exciter section and coupled to said signal feed port and having a distal edge.

2. A radiating element as in claim 1, wherein said balun section has two signal feed ports, and said exciter section and said radiating section are each coupled to both signal feed ports.

3. A radiating element as in claim 2, wherein said exciter section includes two elongated segments extending nominally parallel to the near edge of said radiating section, each said segment connected to a different one of the two signal feed ports.

4. A radiating element as in claim 3, wherein said radiating section is of flat rectangular form with the long sides comprising said near and distal edges.

5. A radiating element as in claim 1, wherein each of said exciter and radiating sections is proportioned so as to be tuned to a frequency in an operating frequency band.

6. A radiating element as in claim 1, wherein said radiating element is stamped in one piece from a flat sheet of sheet metal and then subjected to a single nominally 90 degree bend, said bend positioned between said first and second portions.

7. An antenna comprising:

a conductive ground plane surface;

a plurality of radiating elements each as in claim 1, said radiating elements positioned in a linear array with said first portion of each radiating element positioned nominally parallel to said ground plane surface; and a signal distribution conductor arranged to couple signals to and from the input/output port of each radiating element;

said plurality of radiating elements and said signal distribution conductor stamped in one piece from said sheet stock.

8. An antenna comprising:

a conductive ground plane surface;

a plurality of radiating elements as in claim 1, said radiating elements positioned in a linear array with said first portion of each radiating element positioned nominally parallel to said ground plane surface; and a signal distribution conductor arranged to couple signals to and from the input/output port of each radiating element;

and wherein, in each of said radiating element, said balun section has two signal feed ports, said exciter section includes two elongated segments, each connected to one of said signal feed ports and extending nominally parallel to the near edge of said radiating section of the element, and said radiating section is of rectangular form with the near edge coupled to said feed ports.

9. A double-tuned radiating element comprising:

a radiating element formed in one piece from thin conductive material and including first and second portions, each of flat configuration, with said second portion positioned nominally normal to and supported by said first portion;

said first portion comprising (i) a balun section having an input/output port and a signal feed port, and (ii) an exciter section coupled to said signal feed port and tuned to a predetermined frequency; and said second portion comprising a radiating section having a near edge connected to said exciter section and coupled to said signal feed port and having a distal edge, said second portion also tuned to said predetermined frequency.

10. A radiating element as in claim 9, wherein said balun section has two signal feed ports and said exciter section includes two elongated segments, each connected to one of said signal feed ports and extending nominally parallel to the near edge of said radiating section.

11. A radiating element as in claim 10, wherein said radiating section is of flat rectangular form with long sides comprising said near and distal edges, and said two signal feed points are coupled to the radiating section at points along said near edge.

12. A radiating element as in claim 9, wherein said radiating section is of flat rectangular form with long sides comprising said near and distal edges.

13. An antenna comprising:

a conductive ground plane surface;

a plurality of radiating elements each as in claim 9, said radiating elements positioned in a linear array with said first portion of each radiating element positioned nominally parallel to said ground plane surface; and a signal distribution conductor arranged to couple signals to and from the input/output port of each radiating element;

said plurality of radiating elements and said signal distribution conductor stamped in one piece from said sheet stock.

14. An antenna comprising:

a conductive ground plane surface;

a plurality of radiating elements as in claim 9, said radiating elements positioned in a linear array with said first portion of each radiating element positioned nominally parallel to said ground plane surface; and a signal distribution conductor arranged to couple signals to and from the input/output port of each radiating element;

and wherein in each said radiating element, said balun section has two signal feed ports, said exciter section includes two elongated segments, each connected to one of said signal feed ports and extending nominally parallel to the near edge of said radiating section of the element, and said radiating section is of rectangular form with the near edge coupled to said feed ports.

15. An antenna, including a double-tuned radiating element, comprising:

a conductive ground plane surface; and a radiating element including a first portion positioned nominally parallel to said ground plane surface and a second portion positioned nominally normal to said ground plane surface and supported by connection to said first portion;

said first portion comprising (i) a balun section having an input/output port and two signal feed ports, and (ii) an exciter section coupled to said signal feed ports and tuned to a predetermined frequency; and said second portion comprising a radiating section having a near edge coupled to said signal feed ports and having a distal edge, said radiating section also tuned to said predetermined frequency; and said radiating element formed in one piece from a flat sheet of conductive material and then subjected to a single nominally 90 degree bend, said bend positioned between said first and second portions.

16. An antenna as in claim 15, including a plurality of said radiating elements positioned in a linear array and a signal distribution conductor connected to the input/output port of each radiating element.

17. An antenna as in claim 15, wherein said exciter section includes two elongated segments, each connected to one of said signal feed ports and extending nominally parallel to the near edge of said radiating section.

18. An antenna as in claim 17, wherein said radiating section is of flat rectangular form with long sides comprising said near and distal edges, and said two signal feed points are coupled to the radiating section at points along said near edge.

19. An antenna as in claim 15, wherein said radiating section is of flat rectangular form with long sides comprising said near and distal edges.

* * * * *